US011605281B2

(12) United States Patent
Ten Kate

(10) Patent No.: US 11,605,281 B2
(45) Date of Patent: Mar. 14, 2023

(54) SYSTEM TO SECURE HEALTH SAFETY DURING CHARGING OF HEALTH WEARABLE

(71) Applicant: KONINKLIJKE PHILIPS N.V., Eindhoven (NL)

(72) Inventor: Warner Rudolph Theophile Ten Kate, Waalre (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 17/176,330

(22) Filed: Feb. 16, 2021

(65) Prior Publication Data

US 2021/0256829 A1 Aug. 19, 2021

Related U.S. Application Data

(60) Provisional application No. 62/977,578, filed on Feb. 17, 2020.

(51) Int. Cl.
*G08B 21/04* (2006.01)
*G08B 21/06* (2006.01)

(52) U.S. Cl.
CPC ..... *G08B 21/043* (2013.01); *G08B 21/0476* (2013.01); *G08B 21/06* (2013.01)

(58) Field of Classification Search
CPC ... G08B 21/043; G08B 21/06; G08B 21/0476
See application file for complete search history.

(56) References Cited

U.S. PATENT DOCUMENTS

| | | | | |
|---|---|---|---|---|
| 6,346,886 | B1 * | 2/2002 | De La Huerga | G07C 9/28 340/573.1 |
| 8,249,547 | B1 * | 8/2012 | Fellner | H04B 1/385 455/404.1 |
| 8,742,901 | B2 | 6/2014 | Miller | |
| 10,008,103 | B1 * | 6/2018 | Hamilton | G08B 3/1016 |
| 10,854,063 | B2 | 12/2020 | Ten Kate et al. | |
| 10,885,342 | B1 * | 1/2021 | Day | G10L 15/07 |
| 11,076,769 | B2 * | 8/2021 | Lee | A61B 5/681 |
| 2004/0172290 | A1 | 9/2004 | Leven | |
| 2005/0075116 | A1 * | 4/2005 | Laird | A61B 5/411 455/456.3 |
| 2006/0214805 | A1 * | 9/2006 | Boujon | G08B 21/088 340/573.1 |
| 2006/0241510 | A1 * | 10/2006 | Halperin | A61B 5/7275 600/534 |
| 2007/0132558 | A1 * | 6/2007 | Rowe | G08B 21/22 340/286.07 |

(Continued)

FOREIGN PATENT DOCUMENTS

| | | | |
|---|---|---|---|
| CN | 103927852 | A | 7/2014 |
| CN | 109360374 | A | 2/2019 |
| WO | 2019151701 | A1 | 8/2019 |

OTHER PUBLICATIONS

International Search Report and Written Opinion, International Application No. PCT/EP2021/052700, dated Jul. 7, 2021.

*Primary Examiner* — Curtis J King

(57) ABSTRACT

In one embodiment, a method (110) that determines conditions including that a user is located in a monitored area and not wearing a wearable device (112), and provides an alert based on the determinations and an input pattern from one or plural sensors (114).

14 Claims, 8 Drawing Sheets

(56) References Cited

U.S. PATENT DOCUMENTS

2007/0132597 A1* 6/2007 Rodgers ..... H04N 7/141 340/573.1
2007/0136102 A1* 6/2007 Rodgers ..... G06Q 10/10 705/3
2007/0162304 A1* 7/2007 Rodgers ..... G06Q 10/087 705/2
2008/0021731 A1* 1/2008 Rodgers ..... A61B 5/1113 705/2
2008/0077020 A1* 3/2008 Young ..... A61B 5/0205 600/484
2008/0117060 A1* 5/2008 Cuddihy ..... A61B 5/1118 340/573.1
2008/0269625 A1* 10/2008 Halperin ..... A61B 5/08 600/508
2009/0091458 A1* 4/2009 Deutsch ..... G16H 40/63 340/573.1
2009/0160660 A1* 6/2009 Nurmela ..... G08B 21/0423 340/573.4
2012/0001765 A1* 1/2012 Boccola ..... G08B 21/24 340/686.1
2012/0029879 A1* 2/2012 Sing ..... A61B 5/1121 702/189
2013/0002434 A1* 1/2013 Cuddihy ..... G08B 21/043 340/573.7
2013/0120147 A1* 5/2013 Narasimhan ..... A61B 5/1117 340/573.1
2013/0141233 A1* 6/2013 Jacobs ..... G16H 20/10 340/521
2013/0143519 A1* 6/2013 Doezema ..... G08B 21/043 455/404.2
2013/0208576 A1* 8/2013 Loree, IV ..... G04G 11/00 368/256
2014/0092247 A1* 4/2014 Clark ..... G08B 21/0476 348/143
2014/0155759 A1* 6/2014 Kaestle ..... A61F 7/007 600/479
2014/0334271 A1* 11/2014 Park ..... G04G 21/06 368/10
2014/0358017 A1* 12/2014 Op Den Buijs ..... A61B 5/1128 600/508
2015/0062022 A1* 3/2015 Rabii ..... G02B 27/017 345/173
2015/0094544 A1* 4/2015 Spolin ..... A61B 5/6831 600/301
2015/0221196 A1* 8/2015 Rafin ..... G08B 21/02 340/521
2015/0242015 A1* 8/2015 Cho ..... G06F 3/0488 345/174
2016/0015314 A1* 1/2016 Dusanter ..... A61B 5/0816 600/301
2016/0037346 A1* 2/2016 Boettcher ..... H04M 1/72412 455/411
2016/0094703 A1* 3/2016 Wernevi ..... H04B 1/385 455/404.2
2016/0153761 A1* 6/2016 Jing ..... G01D 21/00 324/207.19
2016/0174025 A1* 6/2016 Chaudhri ..... H04B 1/385 455/41.3
2016/0227009 A1* 8/2016 Kim ..... H04N 7/185
2017/0221335 A1* 8/2017 Brillaud ..... G08B 21/0469
2017/0270461 A1* 9/2017 Morgenthau ..... H04W 52/0216
2017/0301214 A1* 10/2017 Chen ..... A61B 5/1118
2017/0303129 A1* 10/2017 Boettcher ..... H04M 1/72412
2018/0099116 A1* 4/2018 Ashby ..... A61M 21/02
2018/0122209 A1* 5/2018 Jefferson ..... A61B 5/0015
2018/0300538 A1* 10/2018 Horie ..... H04N 7/18
2018/0322759 A1* 11/2018 Devdas ..... A61B 5/0024
2018/0333052 A1* 11/2018 Chamberlain ..... A61B 5/0022
2019/0069154 A1* 2/2019 Booth ..... G06F 1/1635
2019/0122521 A1* 4/2019 Devdas ..... G08B 21/0446
2019/0147721 A1 5/2019 Avitan et al.
2019/0201275 A1* 7/2019 Chamberlain ..... G08B 21/0461
2019/0392157 A1* 12/2019 Sato ..... G06F 21/62
2020/0060910 A1* 2/2020 Lightcap ..... A61G 7/005
2020/0178887 A1* 6/2020 Correa ..... A61B 5/4806
2020/0289033 A1* 9/2020 Sivertsen ..... A61B 5/1117
2020/0409409 A1* 12/2020 Xie ..... G08B 21/24
2021/0082270 A1* 3/2021 Komatsu ..... G08B 21/0476
2021/0150872 A1* 5/2021 Ten Kate ..... G08B 29/188

* cited by examiner

SYSTEM TO SECURE HEALTH SAFETY DURING CHARGING OF HEALTH WEARABLE

CROSS-REFERENCE TO PRIOR APPLICATIONS

This application claims the benefit of U.S. Provisional Application No. 62/977,578, filed on 17 Feb. 2020. This application is hereby incorporated by reference herein.

FIELD OF THE INVENTION

The present invention is generally related to personal emergency response systems.

BACKGROUND OF THE INVENTION

Elderly facing physical and/or mental decline are in need of care. Many wish to stay in their own house. However, even for those that wish to move to a care facility (or need to move there), the presence of adequate care providers is not continual. A Personal Emergency Response System (PERS) provides a solution for assisting elderly care in each case. In such systems, a wearable device, typically in the form of a pendant or a watch-like device, may be worn or carried by the user and used for enabling the user to communicate a request for help (e.g., to an emergency call center, family member, care provider, etc.) in the event of an emergency. The wearable device is typically equipped with a help button, which by the user pressing, secures a connection to a care provider. More sophisticated PERS wearable devices may include, in addition to a help button, one or more sensors that enable the automatic detection of emergency situations, such as falls.

The PERS wearable devices tend to be small in size with a limited battery capacity. Accordingly, such devices need to be recharged. However, one shortcoming for some PERS wearable devices is that during charging operations, the user is no longer in possession (e.g., not wearing or holding) the wearable device, leaving the user vulnerable to monitoring of falls and/or other emergency situations.

SUMMARY OF THE INVENTION

One object of the present invention is to develop an apparatus that provides alerts when a wearable device of a user is unavailable to provide such alerts. To better address such concerns, in a first aspect of the invention, a method that determines conditions including that a user is located in a monitored area and not wearing a wearable device, and provides an alert based on the determinations and an input pattern from one or plural sensors. The invention thus provides protection for the user, in the case of an emergency situation, when personal monitoring functionality of the wearable device is unavailable to the user.

In one embodiment, the method determines that the user is located within the monitored area based on receiving input from the one or plural sensors. The plural sensors thus provide a mechanism to monitor the user when the wearable device is detached from the user or otherwise not receiving user activity input.

In one embodiment, the method determines that the wearable device of the user is not being worn by the user based on one or a combination of receiving an internal indication of whether there is a charging operation occurring between the wearable device and a charging apparatus or receiving an externally communicated indication that the wearable device is or is not being worn. Thus, the method determines whether the wearable device is in the process of being charged, not being worn by the user, and/or even whether functionality of the wearable device is otherwise compromised (e.g., out of charge, broken, etc.), which is an indication that an alternative form of emergency situation determination and alerts is needed for the user. Externally communicated refers to the receipt of signals from a device that is external to the module providing the functionality for monitoring in lieu of the wearable device.

In one embodiment, the receiving of the pattern of input corresponds to one or a combination of motion detection and non-motion detection events detected from the one or plural sensors, at least one of the one or plural sensors associated with only one zone among a plurality of non-overlapping zones collectively monitored by the one or plural sensors. The one or plural sensors may comprise stationary sensors (e.g., dedicated to fall detection or part of an existing system via Internet of Things (IoT) technology) arranged in a manner to monitor their respective zones. For instance, for a monitored area like a bedroom, one sensor may be arranged to monitor a bed surface, and another sensor may be arranged to monitor the floor next to the bed without monitoring the bed surface, where the pattern of inputs enable a determination of whether the user is in an emergency situation when the wearable device is unavailable.

In one embodiment, a motion detection event corresponds to a detection of user activity and a non-motion detection event corresponds to termination of the detection of the user activity, and the plural sensors comprise a first sensor arranged to monitor user activity on a bed surface in a room and a second sensor arranged to monitor user activity on a floor surface of the room, further comprising providing the alert based on the pattern comprising a latest non-motion detection event of the second sensor occurring after a latest non-motion detection event of the first sensor plus a predetermined duration after the latest non-motion detection event of the first sensor. For instance, if a user falls, the input pattern is used to determine that the user has gotten out of bed and yet has not moved since being on the floor for a certain duration, suggesting an emergency situation (e.g., the user has fallen and cannot get up).

In one embodiment, the method further comprises providing the alert based on the pattern comprising no user activity detected a predetermined duration after a latest non-motion detection, non-sleeping event of the first sensor or the second sensor. For instance, the user may have left the bedroom, and has not returned, suggesting that the user is in an emergency situation.

In one embodiment, the method further comprises determining whether to provide the alert based on an evaluation of primitive sleep events based on input from the first and second sensors relative to multiple determined states of user activity, wherein sleep epochs of the primitive sleep events are combined or discarded based on one or a combination of a predetermined duration of each of the sleep epochs or a predetermined gap between time-adjacent sleep epochs. The method thus discerns whether the user is sleeping or is indeed in an emergency situation.

These and other aspects of the invention will be apparent from and elucidated with reference to the embodiment(s) described hereinafter.

BRIEF DESCRIPTION OF THE DRAWINGS

Many aspects of the invention can be better understood with reference to the following drawings, which are diagrammatic. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF EMBODIMENTS

Figure 1:
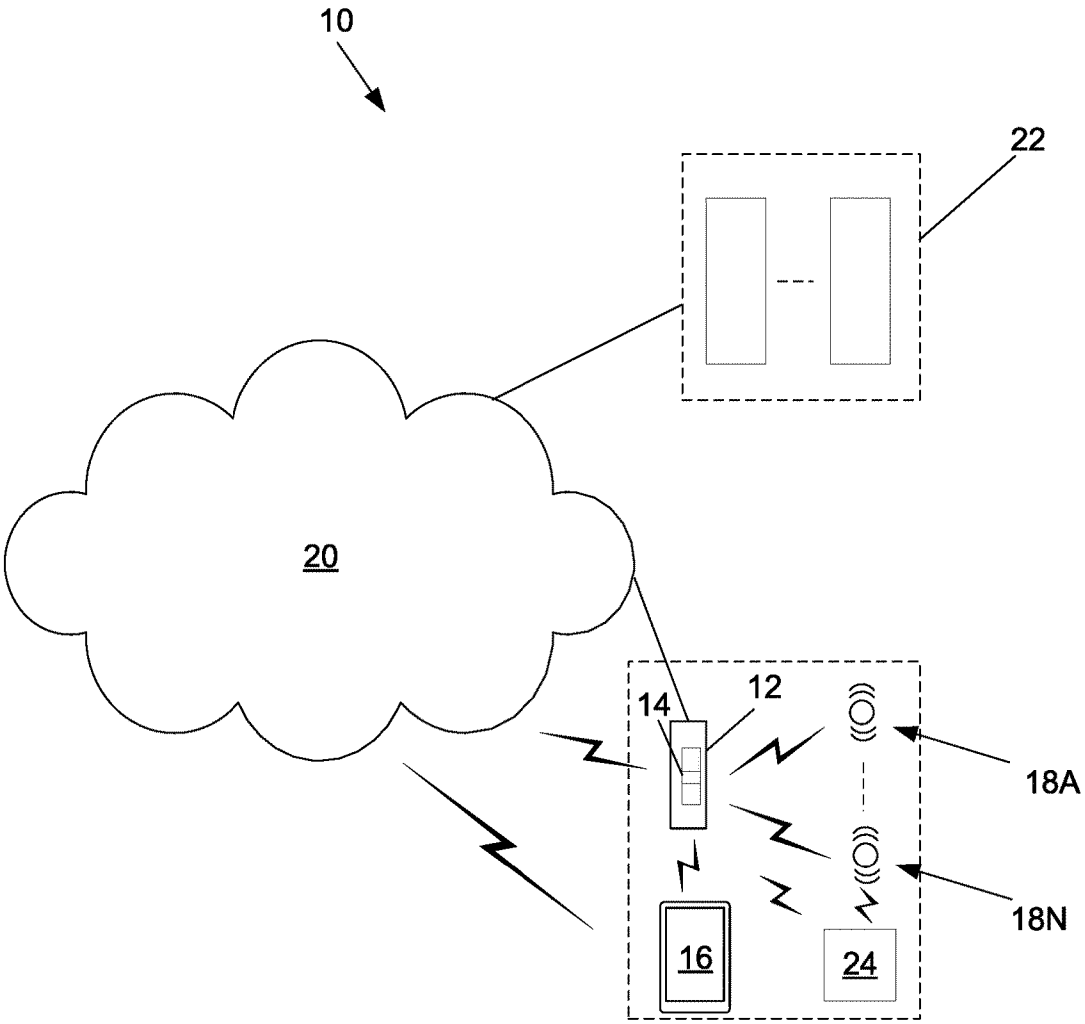
FIG. 1 is a schematic diagram that illustrates an example environment in which a personal emergency response system (PERS) may be implemented, in accordance with an embodiment of the invention.

Disclosed herein are certain embodiments of a personal emergency response system (PERS) and associated method, apparatus, and computer program product (e.g., non-transitory computer readable medium) that monitor the health of a user and provide the necessary alerts (e.g., to a caregiver, third party, emergency services, etc.) during an emergency situation when a PERS wearable device of the user, which likewise performs these functions, is unavailable for monitoring user activity. In one embodiment, the personal emergency response system comprises one or plural sensors that each monitor user activity in a respective zone of a given area or areas that includes a location for a charging device for the PERS wearable device. The personal emergency response system further comprises a PERS module that determines that the user is in the monitored area and that the wearable device is unavailable (e.g., not sensing activity of the user) and, based on the determinations of these conditions and an input pattern received from the one or plural sensors, provides an alert. For instance, the input pattern indicates whether the user is in an emergency situation, including that the user has fallen or is in a condition of incapacity (e.g., rendered unconscious, etc.).

Digressing briefly, current personal emergency response systems leave a user vulnerable in the sense that the system is unable to alert others in the case of an emergency situation when the user is not wearing the PERS wearable device. For instance, the PERS wearable device may be detached from the user and undergoing a charging operation, or the PERS wearable device may become corrupted (e.g., inactive due to component failure) or may run out of charge. There are personal emergency response systems that enable a PERS wearable device to undergo a charging operation while attached to the user's wrist or secured to a user via other mechanisms (e.g., a lanyard), but charging in those instances is typically limited to times when the user is seated near the charging device and/or the user remains cognizant during the charging operation, as it may be awkward and/or uncomfortable to wear the PERS wearable device while sleeping. In contrast, certain embodiments of a personal emergency response system provide the ability to determine an emergency situation and provide alerts even when the monitoring/alerting functionality of the PERS wearable device is unavailable (e.g., not being worn), which helps preserve the safety and well-being of a user.

Having summarized certain features and benefits of a personal emergency response system of the present disclosure, reference will now be made in detail to the description of a personal emergency response system as illustrated in the drawings. While a personal emergency response system will be described in connection with these drawings, there is no intent to limit the personal emergency response system to the embodiment or embodiments disclosed herein. For instance, though certain embodiments of a personal emergency response system are described using plural sensors viewing non-overlapping zones, in some embodiments, a single sensor or fewer sensors with overlapping zones may be used with one or more (learning) algorithms that determine whether a user is sleeping or not, whether the user is wearing a PERS wearable device or not, and further determining user activity indicative of a fall event and/or other emergency condition. Further, although the description identifies or describes specifics of one or more embodiments, such specifics are not necessarily part of every embodiment, nor are all various stated advantages necessarily associated with a single embodiment or all embodiments. On the contrary, the intent is to cover all alternatives, modifications and equivalents consistent with the disclosure as defined by the appended claims. Further, it should be appreciated in the context of the present disclosure that the claims are not necessarily limited to the particular embodiments set out in the description.

Note that description herein that refers to a determination performed according to one or more personal emergency response system functionality includes inferences based on the receipt of certain signals or, in general, input or patterns of input.

Referring now to FIG. 1, shown is an example environment 10 in which certain embodiments of a personal emergency response system may be implemented. It should be appreciated by one having ordinary skill in the art in the context of the present disclosure that the environment 10 is one example among many, and that some embodiments of a personal emergency response system may be used in environments with fewer, greater, and/or different components than those depicted in FIG. 1. The environment 10 comprises a plurality of devices that enable communication of information throughout one or more networks. The depicted environment 10 comprises a charging apparatus 12, a PERS wearable device 14, an electronics device 16, one or plural (e.g., equivalently, one or more) sensors 18 (e.g., 18A . . . 18N), a network 20, and one or more devices (e.g., computing and/or communication devices) of a PERS (service)

facility 22, some of which may be used by agents (personnel) of the facility to assist a user or users of the personal emergency response system.

The PERS wearable device 14 is typically worn by the user (e.g., around the wrist in the form of a watch, strap, or band-like accessory, suspended from the user's neck as a pendant, or attached to an article of clothing), and in one embodiment, comprises one or more processors, a plurality of sensors, a communications module, a position location module (e.g., GPS module), an optional cellular/wireless module, and a rechargeable battery, among other components described below. The sensors may comprise an air pressure sensor and a single or multi-axis accelerometer (e.g., using piezoelectric, piezoresistive or capacitive technology in a microelectromechanical system (MEMS) infrastructure), respectively, for the detection of, for instance, falls. In some embodiments, the sensors may further, or alternatively, include functionality for the detection and measurement of a plurality of physiological and behavioral parameters. For instance, typical physiological parameters include heart rate, heart rate variability, heart rate recovery, blood flow rate, activity level, muscle activity in addition to arm direction, including core movement, body orientation/position, power, speed, acceleration, etc., muscle tension, blood volume, blood pressure, blood oxygen saturation, respiratory rate, perspiration, skin temperature, electrodermal activity (skin conductance response), body weight, and body composition (e.g., body mass index or BMI), and articulator movements (especially during speech). Typical behavioral parameters or activities including walking, running, cycling, and/or other activities, including shopping, walking a dog, working in the garden, sports activities, browsing internet, watching TV, typing, etc., eating, drinking, cooking or other forms of meal preparation, bathing, personal hygiene, toileting, (un)dressing, sleeping, and medication intake. One of the sensors may be embodied as an inertial sensor (e.g., gyroscopes) and/or magnetometers. The sensors may also include flex and/or force sensors (e.g., using variable resistance), electromyographic sensors, electrocardiographic sensors (e.g., EKG, ECG), magnetic sensors, photoplethysmographic (PPG) sensors, bio-impedance sensors, infrared proximity sensors, acoustic/ultrasonic/audio sensors, a strain gauge, galvanic skin/sweat sensors, pH sensors, temperature sensors, and photocells. The sensors may include other and/or additional types of sensors for the detection of environmental parameters and/or conditions, for instance, barometric pressure, humidity, outdoor temperature, pollution, noise level, light level, etc. One or more of these sensed environmental parameters/conditions may be influential in the determination of the state or condition of the user. In some embodiments, the sensors may be embodied as an image capture device comprising an optical sensor (e.g., a charged coupled device (CCD) or a complementary metal-oxide semiconductor (CMOS) optical sensor). For instance, the image capture device may be used to detect various physiological parameters of a user, including blood pressure based on remote photoplethysmography (PPG). In some embodiments, all or a portion of the sensor functionality may be omitted, or performed all or in part at another device (e.g., the electronics device 16) and communicated to the PERS facility 22 in conjunction with (or separate from) any alerts.

The PERS wearable device 14 may further comprise fall detection software or other emergency assist software that receives an indication of an emergency event (e.g., either detected autonomously based on the use of one or more sensors and/or via a user depressing a button or other input) and responsively triggers an action at (e.g., sends an alert to) one or more devices of the PERS facility 22 or other devices (e.g., to a family member, friend, third party, or other caregiver). An agent at the PERS facility 22 can assist the user by contacting, on behalf of the user, emergency personnel and/or other designated caregivers. Communication between the PERS wearable device 14 and the PERS facility 22 may be achieved via the network 20, which may include one or any combination of a cellular network, a wireless network (e.g., Wireless Fidelity or Wi-Fi, 802.11, Zigbee, etc.), local and/or wide area network, and/or other networks. In one embodiment, the PERS wearable device 14 communicates with the PERS facility 22 directly (e.g., using cellular modem functionality) or via an intervening communication through the electronics device 16.

The charging apparatus 12, as explained further below in association with FIG. 7, comprises functionality for charging the PERS wearable device 14. In one embodiment, the charging apparatus 12 may comprise a cradle, stand, docking station, or other type of mounting arrangement that secures the PERS wearable device 14 to the charging apparatus 12 and charges the PERS wearable device 14. The charging apparatus 12 may be configured according to any one of a plurality of different charging mechanisms/structures. In one embodiment, the charging apparatus 12 may use an inductive coupling mechanism that uses an alternating magnetic field generated by a transmitter coil, which induces an alternating voltage in a receiving coil. By coupling (e.g., via a magnetic coupler) the PERS wearable device 14 to the receiving coil, power is transferred to the PERS wearable device 14. In some embodiments, the inductive coupling mechanism may be embodied as a resonant circuit (e.g., LC, RLC, etc.) to provide resonant inductive coupling. In some embodiments, a standard plug-in, USB charger may be used, with the plug at or proximal to a wall outlet and wiring routed to the charging apparatus, or with the plug integrated into or plugged into the charging apparatus and wired to the outlet. In some embodiments, charging functionality may be achieved using radio frequency (RF), ultrasound, light (e.g., laser), among other technologies. As explained further below, the charging apparatus 12 may be integrated within or associated with a PERS apparatus (e.g., see FIG. 7) that provides communications functionality to enable communications between local and/or remote devices via the network 20. The presence of the PERS wearable device 14 in (or not in) the charging apparatus 12 and/or an indication that the PERS wearable device 14 is undergoing (or not undergoing) a charging operation may be flagged by the charging apparatus 12 and/or the PERS wearable device 14 using a status identifier (e.g., a status bit, signal at a predetermined voltage level and/or frequency, etc.), which may be communicated to one or more modules residing in a PERS apparatus. Similarly, the fact that the user is wearing (or not wearing) the PERS wearable device 14 may be detected by one or more sensors in the PERS wearable 14, and the wearing status (e.g., a status bit, signal at a predetermined voltage level and/or frequency, etc.) may likewise be communicated to one or more modules residing in the PERS apparatus.

The electronics device 16 (or electronic devices 16) may be embodied as a smartphone, mobile phone, cellular phone, smart watch, pager, stand-alone image capture device (e.g., camera), laptop, tablet, workstation, smart glass (e.g., Google Glass™), hearing aid, virtual reality device, augmented reality device, among other handheld and portable computing/communication devices. In some embodiments, the electronics device 16 is not necessarily readily portable or even portable. For instance, the electronics device 16 may be a home appliance, including a refrigerator, microwave, oven, pillbox, home monitor, or stand-alone home virtual assistant device. In any event, the electronic device 16 may be communicatively coupled to the PERS wearable device 14, a PERS apparatus, and/or the PERS facility 22 via the network 20 (which may include a home Internet connection, telephony network, cable network, wireless network, local area network, Bluetooth network, Zigbee network, etc.). In some embodiments, the electronics device 16 may be a vehicle appliance (e.g., the automobile navigation system or communication system). In the depicted embodiment of FIG. 1, the electronics device 16 is embodied as a smartphone, though it should be appreciated that the electronics device 16 may take the form of other types of devices including those described above, and is thus shown as a smartphone for illustration.

The one or plural sensors 18 (e.g., 18A-18N) may be arranged in an area that covers one or more rooms and one or more zones per room. In some embodiments, as indicated above, a single sensor 18 may be used and embodied as, for instance, radar or an imaging device or other matrixed sensor that in cooperation with software provides location resolution to discern each zone among multiple zones. In the depicted example, an area, represented by the dashed box surrounding the charging apparatus 12, the PERS wearable device 14 shown resting on the charging apparatus 12, the electronics device 16, and plural sensors 18, may be a room (or sub-divided into multiple rooms) that is monitored by the plural sensors 18. In one embodiment, the plural sensors 18 are arranged within the area to monitor multiple zones within the area, and in one embodiment, each of the zones are exclusively monitored by one or more of the plural sensors 18. In other words, in one embodiment, there is no overlap of coverage from the plural sensors 18 among zones, as is explained further below in association with FIGS. 2A-2B. In some embodiments, only one of the plural sensors 18 provide exclusive coverage (e.g., enabling a determination of whether a user is sleeping or not but providing no fall monitoring). In some embodiments, a single sensor 18 may be used to monitor multiple zones. Reference hereinafter will be to plural sensors 18, except as otherwise noted, with the understanding that a single sensor 18 may be used in some embodiments. The plural sensors 18 may be of the same type or a mixture of different types. In one embodiment, one or more of the plural sensors 18 comprise motion sensors (e.g., passive infrared (IR) sensors or PIRs). In some embodiments, where cost and/or intrusiveness/privacy is of less concern, one or more of the plural sensors 18 comprise imaging devices based on complementary metal-oxide-semiconductor (CMOS) technology, charge-coupled device (CCD) technology, among other imaging technology. For instance, cameras, both in the visible and infrared spectrum, may be used. Resolution of these cameras may be reduced (e.g., 16×16 pixels), though larger resolution sizes enable refinement of fall detection and other usages such as pulse and respiration rate monitoring. In some embodiments, the plural sensors 18 may comprise radar, LIDAR, and/or ultrasonic-based technology. The plural sensors 18 may be comprised of stand-alone, dedicated motion sensors that are wall mounted and designed specifically for the personal emergency response system, or integrated with other systems (e.g., using home security system devices, smoke/fire alarm devices, appliances, etc.) such as via an IoT platform.

The network 20 may comprise one or a combination of networks that enable communication between a PERS apparatus, the charging apparatus 12, the PERS wearable device 14, and/or electronics device 16 and one or more devices of the PERS facility 22. For instance, the network 20 may include a cellular network that includes the necessary infrastructure to enable cellular communications. There are a number of different digital cellular technologies suitable for use in the cellular network, including: GSM, GPRS, CDMAOne, CDMA2000, Evolution-Data Optimized (EV-DO), EDGE, Universal Mobile Telecommunications System (UMTS), Digital Enhanced Cordless Telecommunications (DECT), Digital AMPS (IS-136/TDMA), and Integrated Digital Enhanced Network (iDEN), among others. As another example, the network 20 may include in addition to, or in lieu of the cellular network, an infrastructure to enable communications via one or a combination of other wired or wireless technologies, including Public Switched Telephone Networks (PSTN), Plain Old Telephone Service (POTS), Integrated Services Digital Network (ISDN), Ethernet, Fiber, Hybrid-fiber Coaxial (HFC), Digital Subscriber Line/Asymmetric Digital Subscriber Line (DSL/ADSL), Wireless-Fidelity/802.11 (Wi-Fi), Zigbee, Bluetooth (BT), BT Low Energy (BTLE), among others.

The PERS facility 22 comprises one or more devices coupled to the network 20, including one or more computing devices networked together, including an application server(s) and data storage. The PERS facility 22 may serve as a cloud computing environment (or other server network) for a PERS apparatus, the charging apparatus 12, the PERS wearable device 14, and/or electronics device 16. In one embodiment, the PERS facility 22 serves as a call or PERS service center, receiving alerts or, in general, communications from the PERS apparatus, the charging apparatus 12, the PERS wearable device 14, and/or electronics device 16 (or in some embodiments, from the plural sensors 18) and providing service agents to communicate with the users of the PERS apparatus, the charging apparatus 12, the PERS wearable device 14, and/or electronics device 16 to assist in his or her emergency. In some embodiments, alerts may be used to trigger device action at the PERS facility 22 and/or elsewhere, including auto-dialing (e.g., to communicate with PERS agents, emergency personnel or family members), remote door unlock (e.g., signals to the user's residence to unlock the door for emergency personnel), remote light activation (e.g., activating an outdoor front light on and off to assist emergency personnel in finding the residence where the user is having an issue), among other device actions. Note that in some embodiments, the PERS apparatus, the charging apparatus 12, the PERS wearable device 14, and/or the electronics device 16 may communicate an alert (e.g., formatted as a text message or voice message or email) to other devices of individuals or entities that are designated (e.g., by the user) as recipients of the alert (i.e., that will assist the subject in the case of a fall or other emergency).

Having described various components of the example environment 10, a PERS module 24 is now introduced, the PERS module 24 providing, in one embodiment, the functionality of determination of an emergency situation and alert provision when the PERS wearable device 14 is unavailable. The PERS module 24 may be a standalone device (e.g., comprising hardware/software) or functionality of the PERS module 24 may be integrated into one or more devices (e.g., in a PERS apparatus as described in association with FIG. 7). In one embodiment, functionality of the PERS module 24 may be integrated into the PERS apparatus, the charging apparatus 12, the PERS wearable device 14, the electronics device 16, one or more devices of the PERS facility 22, or any combination thereof. In the following description, the PERS module 24 is described as residing in the PERS apparatus of FIG. 7 that comprises the charging apparatus 12 for ease of illustration/explanation, with the understanding that functionality of the PERS module 24 may reside in other and/or additional devices locally and remote to the monitored area. Note that a module as used herein may include software (which includes firmware, middleware, and/or op-code), hardware (e.g., a microprocessor, microcontroller, digital signal processor, an electronic circuit of discrete components or logic gates), or a combination of software and hardware.

Figure 2A:
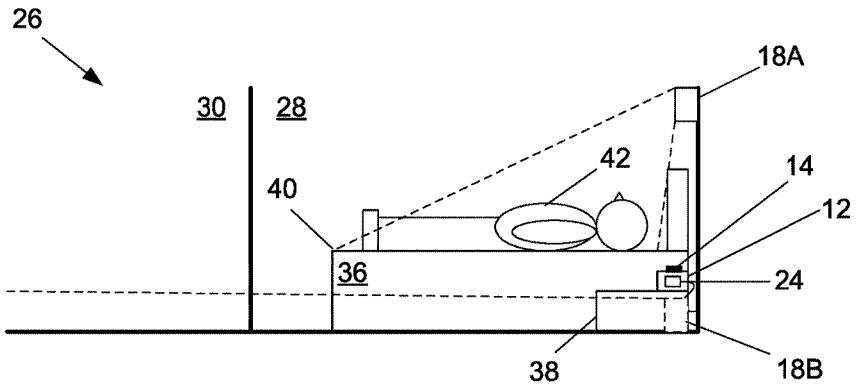
FIGS. 2A-2B are schematic diagrams that illustrate an example home environment where plural sensors are used in conjunction with a PERS module to monitor user activity when the user is not wearing a wearable device, in accordance with an embodiment of the invention.
Figure 2B:
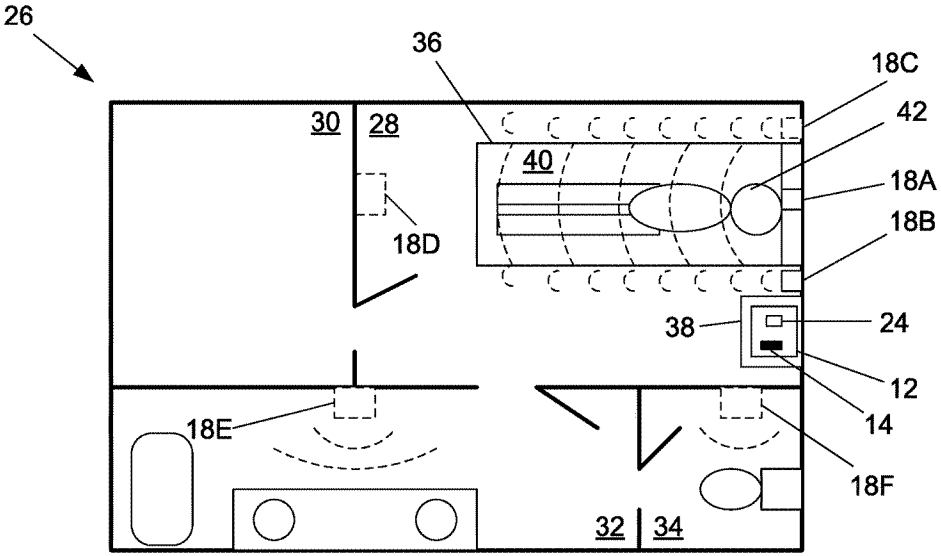

Referring now to FIGS. 2A-2B, shown are schematic diagrams that illustrate an example home environment 26 where plural sensors 18 are used in conjunction with a PERS module 24 to monitor user activity when the PERS wearable device 14 is unavailable to a user 42. As noted above, some embodiments may use a single sensor 18. In this example, the unavailability of the PERS wearable device 14 is described as being due to the PERS wearable device 14 being detached from the user 42 and undergoing a charging operation. For instance, the charging of the PERS wearable device 14 may occur during the night when the user 42 is sleeping, which provides the user an opportunity to be unencumbered by the PERS wearable device 14 for a prolonged period of time. However, unavailability of the PERS wearable device 14 may more broadly be based on simply not being worn by the user, or based on other, non-charging operation scenarios, including where the PERS wearable device 14 is otherwise inactive (e.g., completely out-of-charge) or corrupted (e.g., broken or disabled). It should be appreciated by one having ordinary skill in the art in the context of the present disclosure that the home environment 26 is a simplified, example environment (e.g., a specific, non-limiting example of the environment 10, FIG. 1) used to conceptually illustrate operations of an embodiment of an example personal emergency response system, and that variations in the physical arrangement of rooms, sensors and/or other devices may be implemented, and hence within the scope of the present disclosure.

The example home environment 26 includes plural rooms 28, 30, 32, and 34. The room 28 in this example comprises a bedroom having a bed 36 and night stand 38 arranged in close proximity to a head end side of the bed 36. Lying on a top surface 40 of the bed 36 is a subject (user) 42. The charging apparatus 12 is located in this example on the night stand 38, where power from a wall outlet (not shown) may be transferred to the charging apparatus 12 (and possibly converted to direct current) via electrical wiring. The PERS module 24 is also shown proximal to the charging apparatus 12. The PERS module 24 and the charging apparatus 12 may be integrated within a single apparatus, or provided as separate units. The PERS module 24 may be integrated into the PERS wearable device 14 in some embodiments. The charging apparatus 12 is configured to receive the PERS wearable device 14 to enable the charging of the PERS wearable device 14. Notably, the charging apparatus 12 or the PERS wearable device 14 is located near the bed side. In this way, when the user 42 removes the PERS wearable device 14, the user 42 is already in view of the PIR sensors 18A, 18B. As long as the PERS wearable device 14 is carried (e.g., worn) by the user 42, the PERS wearable device 14 takes control of the monitoring of the user 42 and provides alerts in case the user 42 experiences an emergency situation (e.g., a fall). On the other hand, by securing the PERS wearable device 14 in or on the charging apparatus 12, the PERS module 24 is informed, and the PIR sensors 18 take over the monitoring (e.g., via communication of an enable signal, status, bit, etc. from the PERS module 24).

In the depicted embodiment, plural sensors 18 are arranged to enable monitoring of user activity in different zones of the room 28. In the description that follows, reference is made to passive infrared sensors (PIRs, which respond to motion) being used as the plural sensors 18, though it should be appreciated that in some embodiments, fewer, other and/or additional types of sensors may be used (e.g., image capture devices, radar, ultrasound, LIDAR, etc.). Generally, the two PIR sensors 18A, 18B are mounted in the sleep area 28 of the user, proximal to the PERS module 24 and charging apparatus 12. When the PERS wearable device 14 is being charged in the charging apparatus 12, the PIR sensors 18A, 18B take over the health monitoring of the user 42. Since sleep tends to happen in a confined area, the user 42 can be protected by these two PIR sensors 18A, 18B based on determining a pattern of input from the two PIR sensors 18A, 18B as explained further below. The PIR sensor 18A may be arranged in a position near the head end and over the bed 36. In this way, the PIR sensor 18A may exclusively monitor a zone that includes the surface 40 of the bed 36, as roughly represented by the dashed waveform lines covering the surface 40 of the bed 36 in FIGS. 2A-2B. That is, user activity that occurs in the bed 36 is monitored by the PIR sensor 18A, while other activity external to the surface 40 of the bed 36 may not be monitored by the PIR sensor 18A. Alternatively, in some embodiments, there may be overlap in zone coverage whereby activity on the bed surface 40 and the floor are detected by a single sensor 18. The other PIR sensor 18B is arranged in a position that enables monitoring, in one embodiment, exclusively of the floor area adjacent the bed 36. In other words, the PIR sensor 18B does not cover the bed surface 40. In some embodiments, the PIR sensor 18B may cover additional zones (e.g., other areas not including the bed surface 40). In this example, the PIR sensor 18B is located near the surface of the floor, between the night stand 38 and the bed 36, enabling a monitored zone of the floor area adjacent one side of the bed 36. In one embodiment, user activity on the bed 36 is not detected or acted upon by the PIR sensor 18B, and user activity on the floor is not detected or acted upon by the PIR sensor 18A (though in some embodiments, as noted above, activity on the floor may be monitored by the PIR sensor 18A). In some embodiments, the floor area adjacent the other side of the bed 36 may comprise a zone that is monitored by another PIR sensor 18C (exclusively this area in some embodiments, or in some embodiments, covering additional zones that do not include the bed surface 40). As indicated above, additional or fewer sensors 18 may be arranged in other and/or additional areas of the room 28 to ensure sufficient coverage. For instance, as shown in phantom in FIG. 2B, a sensor 18D (or more sensors) may be positioned at a wall, opposite the wall at the head end of the bed 36, to provide a different viewpoint for monitoring the bed surface (and/or floor zones in the case of floor-directed sensors). In some embodiments, the PIR sensor 18A may be positioned above the door leading into the room 28 (e.g., from room 30).

In this embodiment, the plural sensors 18 send signals (e.g., input) to the PERS module 24. The PERS module 24 determines from a particular pattern of the inputs whether the user is experiencing an emergency situation. That is, based on the determined pattern, the PERS module 24 is able to determine whether the user 42 has fallen or is otherwise experiencing an emergency situation (and/or determine that the situation is a non-emergency situation) and then (in the case of an emergency) provide an alert to a caregiver or other persons or personnel that may assist the user 42. Normally, the PERS wearable device 14 performs these monitoring/alert functions, but as explained above, the PERS wearable device 14 in this example is detached from the user and undergoing a charging operation in the charging apparatus 12, and hence its detection/alert functionality is unavailable. Thus, an embodiment of a personal emergency response system provides monitoring and alert functionality in the absence of such functionality normally provided by the PERS wearable device 14.

In some embodiments, information gleaned from the plural sensors 18 may be supplemented by additional sensors located in other rooms. For instance, in this example, rooms 32 (bathroom) and 34 (toilet room) each comprises a respective PIR sensor 18E and 18F that are used to monitor user activity when the user 42 leaves the room 28. More particularly, PIR sensor 18E exclusively monitors user activity in the bathroom 32 and the PIR sensor 18F exclusively monitors user activity in the toilet room 34. The pattern of inputs from these additional sensors 18E, 18F may be used to make more intelligent decisions as to whether the user 42 has fallen or is otherwise experiencing an emergency situation, or instead is merely delayed in returning to the room 28 for other non-emergency reasons. In some embodiments, the additional sensors 18E, 18F may alternatively or additionally provide data for determining certain health and/or sleeping patterns.

Digressing briefly, as indicated above, the personal emergency response system may be implemented using one or plural sensors 18. A single sensor embodiment may use a single device that is located at only one location in the room (e.g., sensor 18D). A single sensor may include a radar device, an ultra-sound device, a camera, or an infrared based device (e.g., using a 16×16 or 64×64 grid/matrix of sensors inside the device to provide suitable spatial resolution). In some embodiments, plural sensors are used, with monitoring based on observing the differential signal strength. For instance, the plural sensors 18 may all scan the room 28 and are able to divide the room 28 into zones, including sensor 18A for the bed area or bed surface 40, and sensor 18B for the zone next to the bed 36. It should be appreciated by one having ordinary skill in the art in the context of the present disclosure that sensor 18B may be, but is not necessarily, restricted to views or zones below the bed 36 or at the foot level. It is observed that PIR sensors tend to have a wide viewing angle, which may cause overlap in plural (e.g., two) zones, which for sensor 18A is of relevance for the fall-detection capability and for sensor 18B is of relevance for sleep-detection capability. In one embodiment, placing sensor 18B below the bed edge, for instance, ensures sensor 18B will not view the bed area 40. Also, placing sensor 18A upside down improves/ensures sensor 18A will not view the zone at the foot level.

Additionally, each of the above sensors 18 may be configured to provide spatial resolution. This spatial resolution feature may be achieved by scanning using an array of transducers inside the sensor device and applying phase shift (delay) between the signal emitted by each transducer (e.g., in case of radar and ultrasound technology). For instance, a pulse (if the signal is pulsed) may be directed sideways, the angle of which being dependent on the phase-shift, geometry of the transducers (their distance), and frequency (wave length) of the emitted signal. Camera and IR technology are similar, responding to different wavelength in the spectrum. A camera usually has a higher resolution. In some implementations, IR may also be implemented using the differential approach, somewhat similar to radar and ultrasonic transducers. It is noted that camera and IR respond to signals emitted in the room (i.e., light), so the room should be sufficiently lightened, which may be less desired for sleep detection. Alternatively, an IR light source may be built-in, which emits pulses being reflected.

Continuing, from the above description and FIGS. 2A-2B, several observations are noted. In one embodiment of a personal emergency response system, a complementary (alerting) system is achieved where the PERS module 24 is active (and the PERS wearable device 14 is not) when the user 42 is in the bedroom 28 and the PERS wearable device 14 is secured in or on the charging apparatus 12 near the bed side, and the PERS wearable device 14 is active (and the PERS module 24 is not) when worn by the user 42. In one embodiment, there is communication between the charging apparatus 12 and/or the PERS wearable device 14 and the PERS module 24 such that state of charging is known to enable activation of the PERS module 24 or the PERS wearable device 14. As noted from FIGS. 2A-2B, one embodiment of a personal emergency response system comprises a two PIR sensor system, where one PIR sensor 18A is viewing the bed area and the other PIR sensor 18B is placed below or proximal to the bottom of the bed 36, such that the PIR sensor 18B views the floor level (but not the bed surface 40). As explained further below, the personal emergency response system detects when the user 42 is sleeping, in which case it disables alerting (such as due to falls and due to being inactive). When not sleeping (and not wearing the PERS wearable device 14), the personal emergency response system provides automatic alerting via functionality of the PERS module 24. For example, the personal emergency response system detects falls near the bed 36 when not wearing the PERS wearable device 14, and the personal emergency response system provides alerts (to the PERS facility 22) when the user 42 is not active for longer than a minimum duration (e.g., lying next to bed, or not returning from the toilet room 34 in time). Optionally, the personal emergency response system may monitor sleep behavior (e.g., sleeping times, sleep duration, circadian rhythm, sleep efficiency, bed leaves) based on input from the plural sensors 18. Though described with the charging apparatus 12 residing in the bedroom 28, in some embodiments, the charging apparatus 12 may reside in other and/or additional rooms, in which case a similar arrangement and manner of operation as described above is used. For instance, the charging apparatus 12 may be located in the bathroom 32 while the user 42 is, say, showering, or located in a living room where the user is sitting (e.g., watching TV).

Reference is now made to the flow diagrams depicted in FIGS. 3-6 in the context of the example home environment 26 of FIGS. 2A-2B. As noted from FIGS. 2A-2B, two PIR sensors 18A, 18B are used in the room 28, though fewer or additional sensors may be used in some embodiments. When the user 42 moves in front of a given PIR sensor's view, a so-called ON event (also referred to herein as a motion detection event) is issued by the sensor. When the motion ends (and in some embodiments, plus a predetermined period of time, such as 15 seconds), or when the user 42 is out of view of a particular PIR sensor, the sensor issues an OFF event (also referred to herein as a non-motion event). In the flow diagrams of FIGS. 3-4 and 6, the PIR sensor 18A is referred to as PirBed, and as explained above, is installed such that it is viewing the bed area (e.g., surface 40 of the bed 36). Note that the location of the PIR sensor 18A may be arranged differently in some embodiments. For instance, the PIR sensor 18A may be mounted with its view gazing over the bed 36 and looking upwards (e.g., typically with its view turned upside-down), such that the PIR sensor 18A is less sensitive to motions near floor level. The PIR sensor 18B is referred to in the flow diagrams of FIGS. 3-4 and 6 as PirFloor, and as explained above, is placed below the bed 36, such that the PIR sensor 18B only views the region or zone at floor level. Stated otherwise, while the PIR sensor 18B (PirFloor) responds only to motions at floor level (or in some embodiments, to motions in additional zones except those on the bed surface 40), the PIR sensor 18A (PirBed) responds to motions above floor level (e.g., on the bed 36) (and possibly motions from additional zones in some embodiments).

Figure 3:
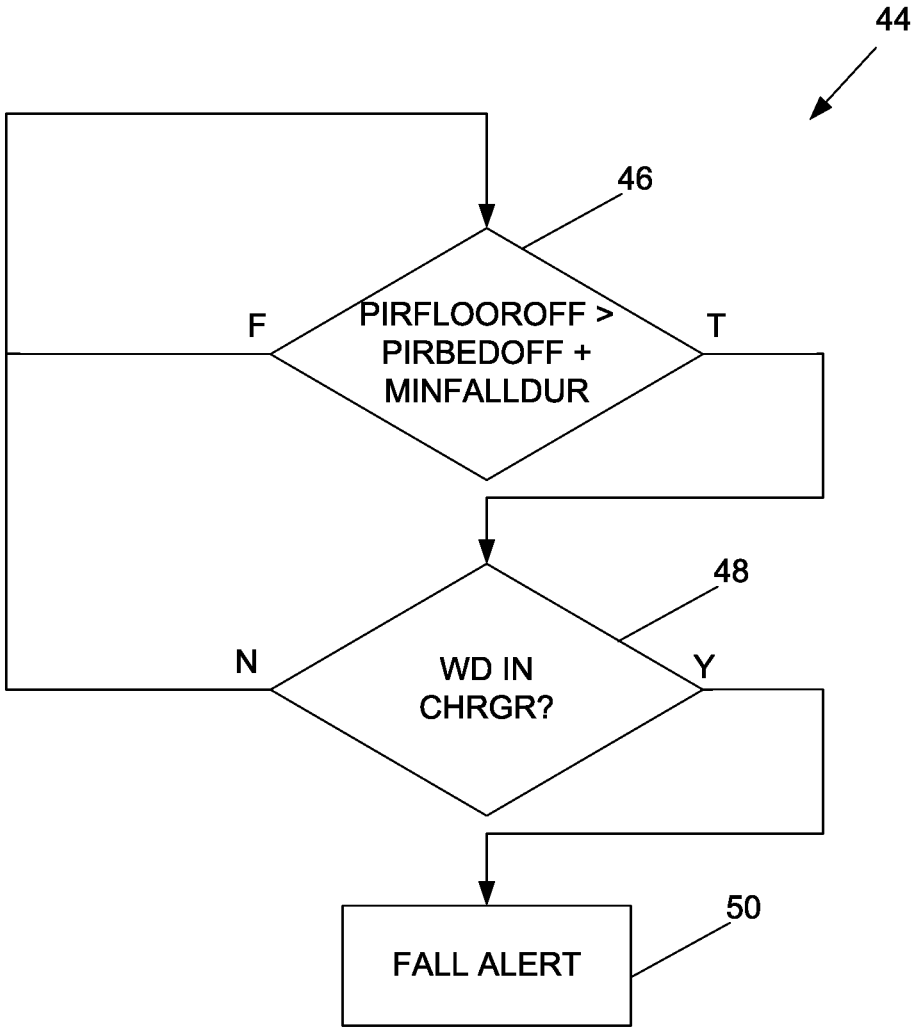
FIG. 3 is a flow diagram that illustrates an example PERS method for determining conditions upon which a PERS module alerts a user, in accordance with an embodiment of the invention.

Referring now in particular to FIG. 3, shown is a flow diagram that illustrates one PERS method 44 that may be implemented by an embodiment of a personal emergency response system. For instance, the method 44 may be implemented by the PERS module 24, where the PERS module 24 looks for certain conditions and a pattern of inputs from the plural PIR sensors 18A, 18B (and from the charging apparatus 12) to determine whether the user 42 is experiencing an emergency situation (e.g., a fall). Different zone monitoring by a single sensor 18 may also be used in some embodiments. In (46), the method 44 determines (e.g., via polling) whether a pattern of inputs exists where an OFF event of the PirFloor sensor 18B (PirFloorOFF) is received a minimum duration (MinFallDur) after the latest OFF event of the PirBed sensor 18A. If false (F), the process continues to evaluate (46). If true (T), the method 44 advances to (48). In (48), the method 44 determines whether a condition exists where the PERS wearable device 14 is secured in or on the charging apparatus 12. If not (N), the method 44 returns to evaluating (46). If so (Y), the method provides an alert (50).

Explaining further, while the user 42 is active in the bedroom (and the PERS wearable device 14 is being charged), the PIR sensors 18A, 18B may be firing. When the user 42 is on the bed 36, only the PIR sensor 18A (PirBed) responds to the motion. PIR sensor 18B has issued an OFF event and does not detect any further motion since user 42 is out of its view. If the user 42 happens to fall (e.g., on the floor), PIR sensor 18B will raise an ON event, while 18A will raise an ON event by motion while still on the bed and, after its time-out period, will raise an OFF event. The OFF event by the PirFloor sensor 18B will be after the OFF event of the PirBed sensor 18A. That is, the OFF event of the PirFloor sensor 18B is later than a minimum duration after the last OFF event by the PirBed sensor 18A. In one embodiment, the MinFallDur is 1 minute, though other values may be used. In this example, the PERS wearable device 14 needs to be in the charging apparatus 12 for the alert to be raised, though in some embodiments, other conditions that render the PERS wearable device 12 unavailable (even if not in the charging apparatus 12) may likewise apply here. In some embodiments, if the PERS wearable device 14 is not in the charging apparatus 12, the PERS wearable device 14 may detect using input from the PIR sensors 18A, 18B by lowering its detection threshold. That is, in some embodiments, there may be circumstances (e.g., when a user 42 is busy during the day while in the bedroom 28) where the PERS wearable device 14 cooperates with the one or plural sensors 18. Note that in some embodiments, the order of steps 46 and 48 may be reversed.

Figure 4:
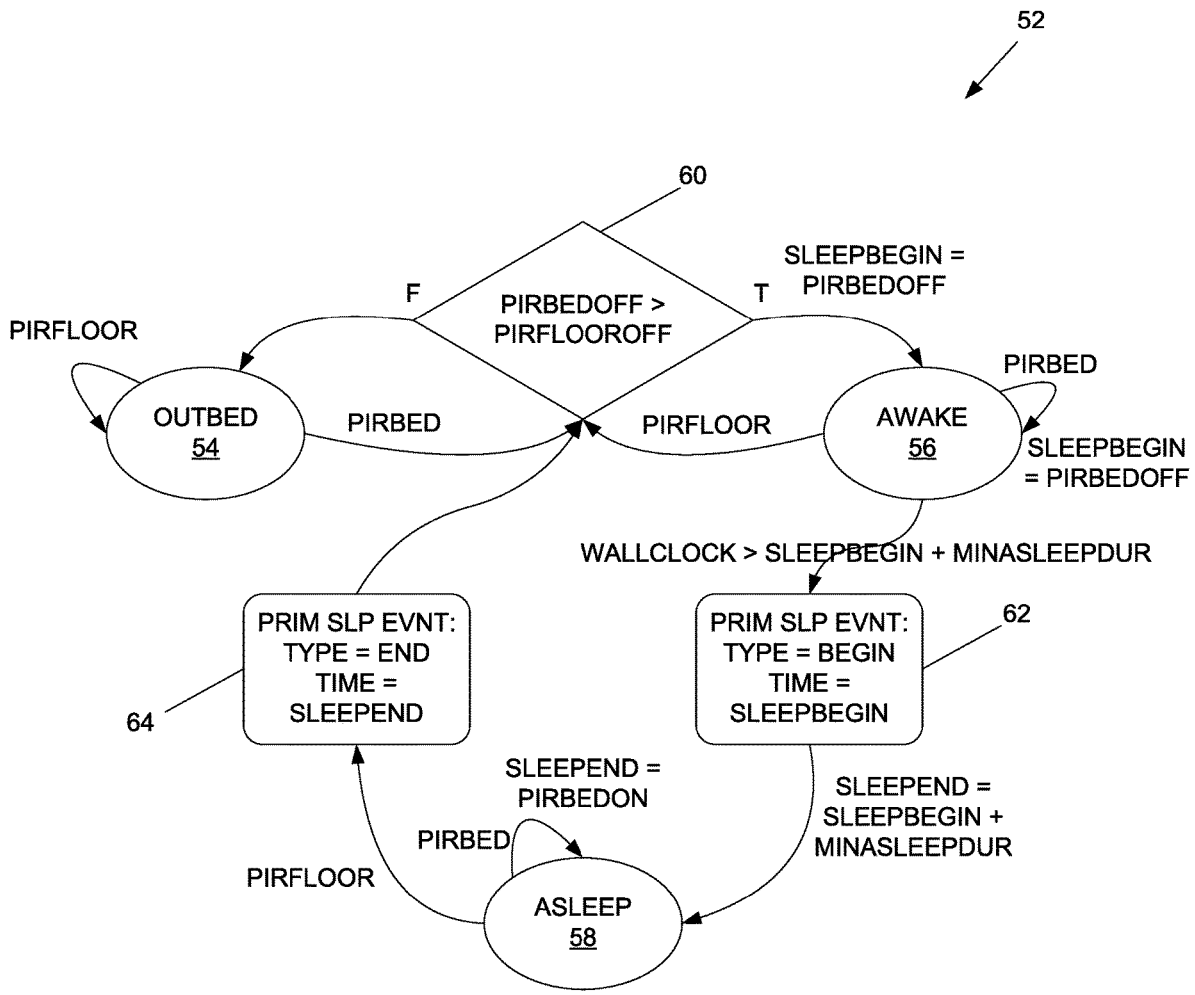
FIG. 4 is a flow diagram that illustrates an example PERS method for using primitive sleep events to determine if a user is sleeping, in accordance with an embodiment of the invention.

It is noted that there may be circumstances where there is no input from the PIR sensors 18A, 18B, though the absence of input may be because the user 42 is sleeping rather than from an emergency situation. FIG. 4 a flow diagram that illustrates an example PERS method 52 for using primitive sleep events to determine if a user 42 is sleeping, which helps to avoid false alarms. The PERS method 52 may be implemented by the PERS module 24. To suppress alerts in case the user 42 is sleeping on the bed 36, the PERS method 52 (a sleep detection algorithm) is run using inputs from the two PIR sensors 18A, 18B. Note that in some embodiments, fewer or additional sensors may be used. Events, as in the method 44, refer to ON or OFF events as detected by the PIR sensors 18A, 18B. The ON and OFF events (e.g., the pattern of sensor inputs) of both sensors 18A, 18B are evaluated for their relationships, which lead to primitive sleep events (SleepBegin, SleepEnd) as depicted in FIG. 4. Shown are three states, including an out of bed state (OutBed) 54, an awake state (Awake) 56, and an asleep (Asleep) state 58. In one embodiment, the method 52 is initiated in the OutBed state 54. When a PirBed event happens, there is an evaluation/determination/detection (60) of whether the PirBed sensor 18A has an OFF time (i.e., PirBedOFF) that is after that of the latest OFF event of the PirFloor sensor 18B (i.e., PirFloorOFF). If true (T), the state is determined to have changed to the Awake state 56, otherwise if false (F), the state is determined to remain in the OutBed state 54. A PirFloor event may bring the method 52 back into the OutBed state 54. However, when in the Awake state 56, and there are no further events for some minimal duration, MinAsleepDur, the beginning of sleeping is detected (SleepBegin), marked by the time of the last PirBedOFF event, and a Primitive Sleep Begin event 62 is raised.

For instance, as noted, the PERS method 52 determines WallClock>SleepBegin+MinSleepDur, where WallClock refers to the current time. Sensor events (with values of either ON or OFF, in this example) may each bear a time stamp. The time stamp may be generated by the sensors 18 or by the PERS module 24 (e.g., upon receipt of a sensor event, such that the PERS module 24 uses the WallClock time at the moment of reception to assign the time stamp). In the depicted test shown in FIG. 4, the method 52 (e.g., the PERS module 24) compares the current wall clock time to the stored variable value (SleepBegin) and a parameter value (MinAsleepDur). Alternatively, the PERS module 24 may wait for a next event to arrive and, in a somewhat retrospective manner, follow the process flows to reconstruct states (e.g., in applications where the PERS module 24 does not have access to a WallClock time (and the sensor events are time stamped by the sensors or other (IoT) source)). In some embodiments (e.g., in case of an IoT scenario), the PERS module 24 may request the wall clock time from an IoT source.

The state moves from Awake 56 to Asleep 58. Subsequent PirBed events (PirBedON) set the end time of sleeping (e.g., every next event updates that value to this next event's (ON) time). In one embodiment, a typical value for MinAsleepDur is 120 seconds, though other values may be used in some embodiments. The end of sleeping happens when a PirFloor event happens, and is indicated by a Primitive Sleep End event 64. A next Sleep Begin may happen to repeat the method 52.

Figure 5A:
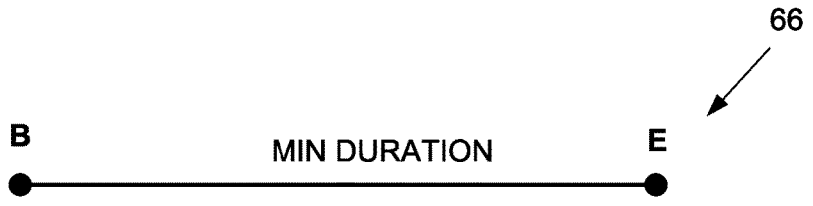
FIGS. 5A-5C are schematic diagrams that conceptually illustrate example sleep epochs used in determining whether a user is sleeping, in accordance with an embodiment of the invention.
Figure 5B:
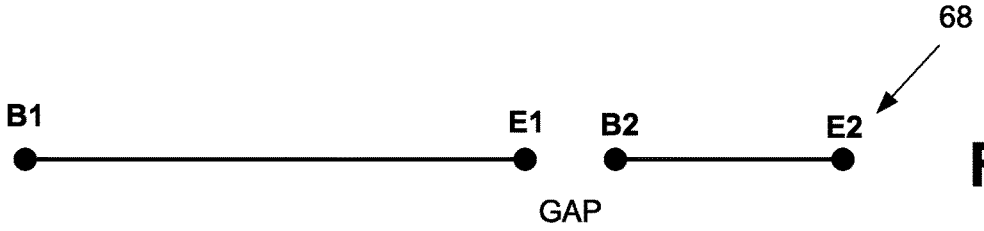
Figure 5C:
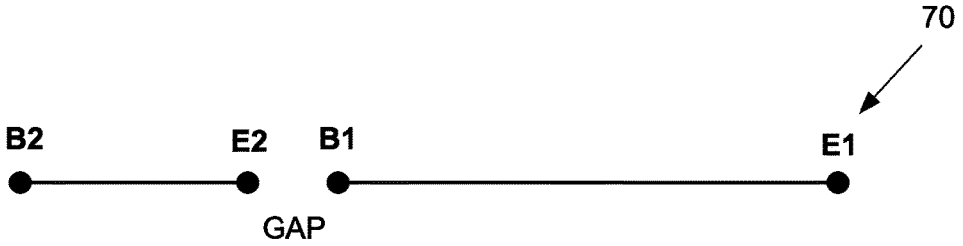

The Primitive Sleep events 62, 64 may be grouped together to determine if the user 42 is sleeping, as shown in FIGS. 5A-5C. Referring to FIG. 5A, every Begin-End (B-E) pair forms a sleeping epoch 66, in case its duration exceeds a minimum (e.g., MIN DURATION). In one embodiment, a typical value for this minimum is 1800 seconds (half hour), though other values may be used in some embodiments. In case the sleeping epoch duration is less than the minimum, the epoch is discarded, unless it is close to another epoch (e.g., separated by a gap), such that their combined duration exceeds the minimum as shown in FIGS. 5B-5C. The threshold value has a minimum value. Clearly, this is the case if one of the epochs is an accepted epoch by itself. In one embodiment, a typical value for a (maximum) gap is 300 seconds, though other values may be used in some embodiments. In one embodiment, this maximum gap should be below the threshold to have the (e.g., two) sleeping epochs concatenated. For instance, and referring to epoch grouping 68 of FIG. 5B, B2−E1<gap. In epoch grouping 70 of FIG. 5C, B1−E2<gap. In some embodiments, the two sleeping epochs should be within the gap threshold and the concatenated duration should exceed MIN DURATION. Stated otherwise, in one embodiment, max(E1, E2)−min(B1, B2)>MIN DURATION. Accordingly, while a user 42 is sleeping, no alert is raised when there is a lack of sensor events for some minimal duration.

Figure 6:
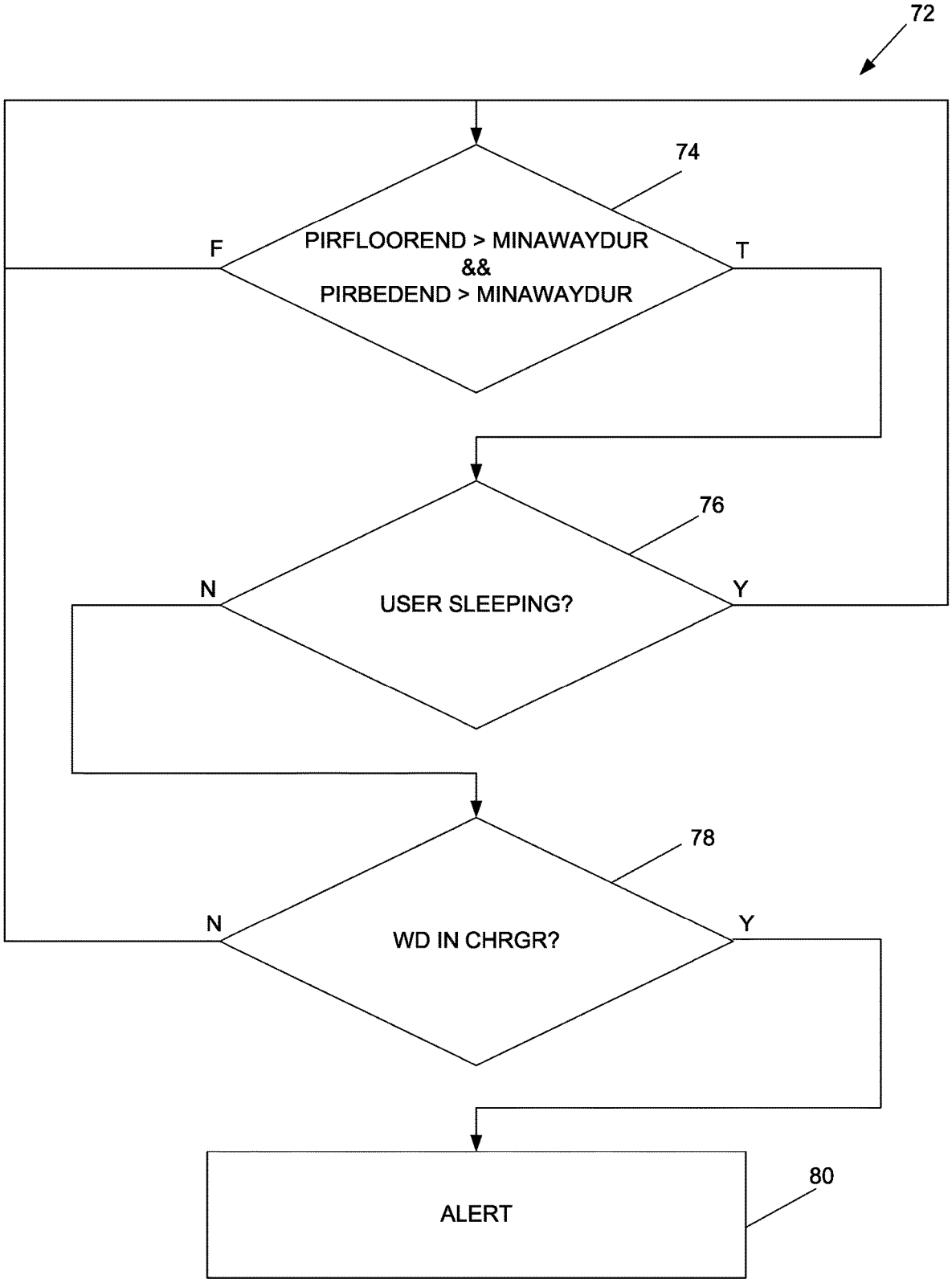
FIG. 6 is a flow diagram that illustrates an example PERS method for determining whether an absence of sensed user activity is indicative of an emergency situation, in accordance with an embodiment of the invention.

Referring now to FIG. 6, shown is a flow diagram that illustrates an example PERS method 72 for determining whether an absence of sensed user activity is indicative of an emergency situation. Note that when the user 42 leaves the room 28 for over a predefined duration, the PERS method 72 raises an alert, as does the PERS method 44 (FIG. 3). For instance, the user 42 may leave the bedroom 28 while the PERS wearable device 14 is secured in or on the charging apparatus 12. The PERS method 72 may be implemented by the PERS module 24. In one embodiment, the PERS method 72 comprises determining whether the user 42 has been undetected by the PIR sensor 18B for a minimum away duration (MinAwaydur) after a PirFloorEnd event (i.e., PirFloorEnd>MinAwayDur) and whether the user 42 has been undetected by the PIR sensor 18A for a minimum away duration (MinAwayDur) from a PirBedEnd event (i.e., PirBedEnd>MinAwaydur) (74). If false (F), the method 72 continues to evaluate (74), otherwise if true (T) the method 72 advances to (76). In (76), the method 71 determines whether the user is sleeping according to the PERS method 52 (FIG. 4). If yes (Y), the method 72 returns to evaluation of (74). If not (N), the method 72 advances to (78), where the method 72 determines whether the PERS wearable device 14 is in the charging apparatus 12. If not (N), the method 72 returns to evaluation of (74). If yes (Y), the method 72 advances to providing an alert (e.g., fall alert) (80).

Thus, the departure from the room 28 silences both PIR sensors 18A, 18B. In case the user leaves the bedroom, for example for toileting and bathroom, the sensors 18A, 18B will be inactive (though in some embodiments, additional sensors 18E, 18F located in those zones may provide feedback as to the nature of the user's absence and/or sleep behavior). An alert (80) is raised if the user does not return (e.g., no PIR event is received, within a pre-set time duration, after the last OFF event of either sensor 18A, 18B). To leave the bedroom 28, the PirFloor sensor 18B detects motion and hence raises an ON (and OFF) event, which then enables the sleep algorithm (76, such as via the PERS method 52) to decide whether the user is non-sleeping. When in addition, the PERS wearable device 14 is known to be on the charging apparatus 12 (78), an alert is raised (80) if the user 42 does not return in the bedroom within a pre-set duration (MinAwayDur). In one embodiment, the value of MinAwaydur is 15 minutes, though other values may be used in some embodiments. Note that an alert is also be raised in case the user falls and movement is not detected for the pre-set time duration, such as when the user 42 is lying on the floor. However, the alert should not be provided if the user 42 is sleeping on the bed 36.

In some embodiments, the steps/tests in the PERS method 72 of FIG. 6 may be re-ordered. For example, the test of the PERS wearable device 14 being in the charging apparatus 12 may be carried out first. Moreover, the event of the PERS wearable device 14 being placed in the charging apparatus 12 may activate the PERS system and the corresponding sensing and alerting.

Though the time duration of being absent from the room 28, before an alert is raised, is a pre-set (predetermined) threshold, in some embodiments, the threshold may be adapted to the user's behavior, accounting for the duration the user is typically away. A similar adaptation might be applied to the other components of the system.

In some embodiment, as noted above, the personal emergency response system may be refined by including additional sensors. For example, PIR sensors 18E, 18F may be placed in other spaces typically visited during the night, such as the bathroom 32 and the toilet room 34, respectively. The use of additional PIR sensors enables refined monitoring of the sleeping behavior, such as the number and duration of toilet visits during night, with the resulting metrics used to monitor the user's health state. For example, Urinary Tract Infection (UTI) may be recognized in this way and adequate help can be offered.

In some embodiments, the sleep events themselves may be monitored (e.g., with the two PIR sensors 18A, 18B). Time of sleeping (e.g., the circadian rhythm) may be monitored, as can be the sleep duration and the number of bed leaves and their durations. By putting these events together in a trend, further analytics may be applied.

Figure 7:
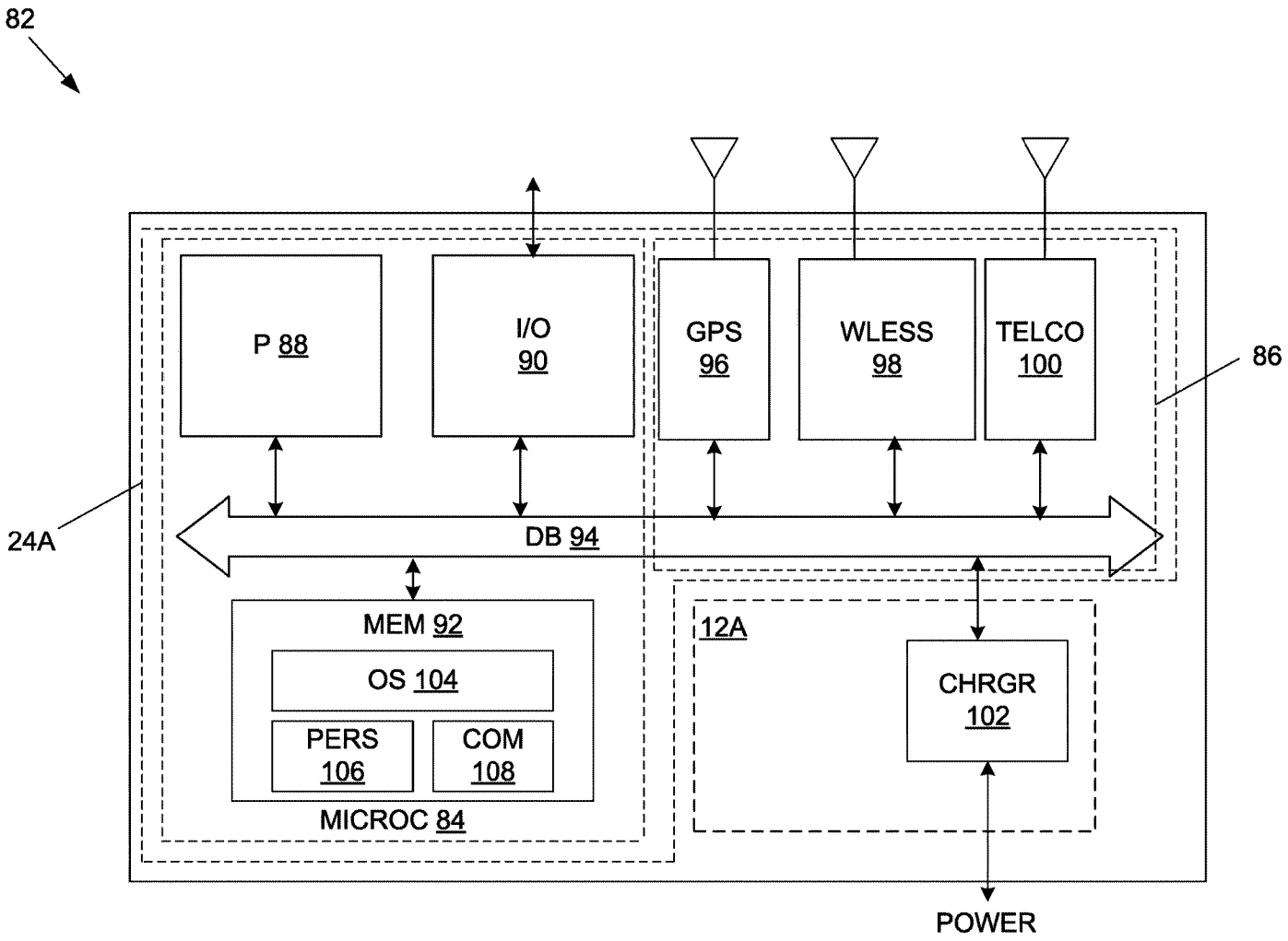
FIG. 7 is a block diagram that illustrates an example PERS apparatus used to monitor user activity and charge a wearable device, in accordance with an embodiment of the invention.

Having described the various PERS methods that may be implemented in a personal emergency response system, and in some embodiments, by the PERS module 24 in conjunction with one or plural sensors 18, attention is now directed to FIG. 7, which illustrates an embodiment of an example PERS apparatus 82 used to monitor user activity during the unavailability of the PERS wearable device 14 and provide alerts, and also used to charge the PERS wearable device 14. In the depicted embodiment, the PERS apparatus 82 comprises the PERS module 24A and the charging apparatus 12A embodied as a single unit. However, it should be appreciated by one having ordinary skill in the art, in the context of the present disclosure, that the architecture depicted in FIG. 7 is one illustrative embodiment, and that in some embodiments, fewer, additional, and/or different components may be used. For instance, the charging apparatus 12 and the PERS module 24 may be separate units. As another example, the PERS module 24 may be integrated in other devices, including as a component of the PERS wearable device 14, the electronics device 16, a device of the PERS facility 22, or as distributed functionality across two or more of the aforementioned devices. For the sake of ease of illustration, the PERS module 24, denoted as PERS module 24A in FIG. 7, is described as a hardware and software component of the PERS apparatus 82, with the understanding that other mechanisms as described above may be used to implement the corresponding functionality. Further, in some embodiments, the PERS module 24A may be implemented with fewer components than illustrated in, and described in association with, FIG. 7, including embodied only as a software module stored on a non-transitory computer readable medium in some embodiments. In one embodiment, the PERS module 24A comprises a microcontroller 84 and a communication and locator module 86. The microcontroller 84 comprises one or more processors 88, input/output (I/O) interfaces 90, and memory 92, all coupled to one or more data busses 94. The communication and locator module 86 comprises an optional GPS module 96, a wireless module 98, and a telephony/cable module 100 coupled to the one or more data busses 94. The charging apparatus 12A comprises a battery charger 102, also coupled to the one or more data busses 94. Note that in some embodiments, additional components may be used and/or the quantity or arrangement of components may be different. For instance, the PERS apparatus 82 may have a user interface and/or status lights (e.g., light-emitting diodes). The user interface may comprise a display screen that provides feedback of charging status, PIR sensor status, and/or whether monitoring/alert provision is via the PERS wearable device 14 or the PERS apparatus 82 (e.g., PERS module 24A). In some embodiments, LEDs may perform this status function. The user interface may also include electromechanical and/or soft (e.g., via a touch-type display screen) buttons/switches that enable user input. In some embodiments, the charging apparatus 12 may alternatively or additionally comprise communication functionality.

The microcontroller 84 comprises a hardware device for executing software/firmware, particularly that stored in the memory 92. The one or more processors 88 of the microcontroller 84 may be embodied as any custom made or commercially available processor, a central processing unit (CPU), a semiconductor based microprocessor (in the form of a microchip or chip set), a macroprocessor, or generally any device for executing firmware/software instructions. The microcontroller 84 provides for management and control of the PERS apparatus 82. Though a microcontroller 84 is described, it should be appreciated by one having ordinary skill in the art in the context of the present disclosure that other processor configurations and/or arrangement of components for like-functionality may be used in some embodiments, including systems on a chip among other arrangements, and hence are contemplated to be within the scope of the disclosure.

The I/O interfaces 90 comprise a plurality of (serial) pins, including serial ports (e.g., UARTS) for the input and/or output of data. In one embodiment, the I/O interfaces 90 are connected to the one or plural sensors 18 via a hard-wired connection. In some embodiments, the one or plural sensors 18 may communicate with the PERS apparatus 82 wirelessly (e.g., signals received via the communication and location module 86). In some embodiments, the I/O interfaces 90 may be connected to other devices, including one or more home appliances/systems. The I/O interfaces 90 may also be coupled to a user interface.

The memory 92 can include any one or a combination of volatile memory elements (e.g., random access memory (RAM, such as DRAM, SRAM, SDRAM, etc.)) and non-volatile memory elements (e.g., ROM, Flash, solid state, EPROM, EEPROM, etc.). In some embodiments, additional memory may be coupled to the data bus 94. Moreover, the memory 92 may incorporate electronic, magnetic, and/or other types of storage media. The memory 92 may be used to store sensor data, contact information (e.g., emergency phone numbers, caregiver phone numbers, family member phone numbers), as well as identifying/address information of the PERS apparatus 82 (e.g., MAC address, SSID) and/or of the one or plural sensors 18. The memory 92 may also store position location information (e.g., GPS coordinates), such as from operations of the GPS module 96, and associate the information to a designated location (e.g., home or room location). The memory 92 may further include instructions (e.g., executable code) in the form of application software, firmware, and/or op-code. For instance, in the depicted embodiment, the memory 92 comprises an operating system 104, PERS software 106, and communications software 108.

The operating system 104 essentially controls the execution of other computer programs, such as the PERS software 106, and provides scheduling, input-output control, file and data management, memory management, and communication control and related services. The operating system 104 may comprise any one of a plurality of different types of operating systems, including WINDOWS or macOS or its derivatives, Unix, Linux, etc.

The PERS software 106 comprises functionality to monitor user activity via sensor input and provide alerts in emergency situations when the PERS wearable device 14 is unavailable, and includes the functionality of at least the PERS methods (e.g., methods 44, 52, 72 of FIGS. 3, 4, and 6 and the method depicted in FIG. 8) described herein. In other words, the PERS software 106 provides the command and control for the PERS module 24A based on the internal detection of PERS wearable device charging or, in general, recognition of when the user 42 is not wearing the PERS wearable device 14 and the receipt of input from the one or plural sensors 18 (external communication). As the functionality of the PERS software 106 has been described herein in association with the methods 44, 52, and 72 of FIGS. 3, 4, and 6, description of the same is omitted here for brevity.

The communications software 108 cooperates with the communication and location module 86 to enable communications according to one or more of a plurality of different communication technologies (e.g., GSM, WCDMA, broadband 3G, 4G, 5G, streaming (e.g., LoRa), NFC, BT/BTLE, Wi-Fi/802.11, Zigbee, etc.). In some embodiments, the communications software 108 may be part of the PERS software 106 or located in separate or other memory.

Referring to the communication and location module 86, the GPS module 96 comprises a GPS receiver including one or more antennas for receiving satellite data and computing a geographical location of the PERS apparatus 82. Though described as a GPS receiver, the GPS module 96 may be configured according to one or more global navigation satellite system (GNSS) capabilities, including GPS, GLONASS, etc. In some embodiments, the GNSS receiver functionality may be replaced with, or augmented by, other position location determination functionality, such as cell tower triangulation, dead-reckoning (e.g., using inertial sensors), among others.

The wireless module 98 comprises one or more antennas and known transceiver circuitry to enable wireless/cellular communications according to one or more communications protocols, including GSM, WCDMA, broadband 3G, 4G, 5G, streaming (e.g., LoRa), NFC, BT/BTLE, Wi-Fi/802.11, Zigbee, etc.). In one embodiment, the wireless module 98 comprises one or more of a wireless modem or cellular modem.

The telephony/cable module 100 comprises functionality for enabling telephone and/or cable communications (e.g., voice over IP, data communications, etc.), and includes functionality for communications via including Public Switched Telephone Networks (PSTN), Plain Old Telephone Service (POTS), Integrated Services Digital Network (ISDN), Ethernet, Fiber, Hybrid-fiber Coaxial (HFC), Digital Subscriber Line/Asymmetric Digital Subscriber Line (DSL/ADSL).

Accordingly, alerts to the PERS facility 22 (or others) may be achieved via wired and/or wireless communications.

Referring to the charging apparatus 12A, the battery charger 102 may comprise a charging/gauge chip to enable a re-charging of the battery of the PERS wearable device 14. The charging apparatus 12A may comprise a cradle or stand to which the PERS wearable device 14 is secured, where the PERS wearable device 14 is either coupled to a USB connection or wirelessly coupled to a magnetic coupler for inductive-based charging. Other known mechanisms for charging may be deployed in some embodiments. The placement of the PERS wearable device 14A into the charging apparatus 12A may trigger an internal switch or be recognized as a pin entry or address identifier (e.g., change in status bit) that is communicated over the data bus 94 to the PERS software 106, enabling the transfer of monitor/alert functionality from the PERS wearable device 14 to the PERS software 106. In some embodiments, the PERS software 106 may in turn activate or enable the functionality of the plural sensors 18. In some embodiments, the plural sensors 18 may continually transmit data to the PERS apparatus 82 yet the data is ignored or only completely acted upon by the PERS software 106 when the PERS wearable device 14 is engaged for a charging operation. In some embodiments, the absence of contact between the PERS wearable device 14 and the user 42 or the detection of corruption of the PERS wearable device 14 or the detection of impending charge loss or near total loss of charge (e.g., as detected by sensors of the PERS wearable device 14) may trigger the communication of a signal to the PERS software 106 and/or the plural sensors 18, which causes the control of monitoring and alert functionality from the PERS wearable device 14 to the PERS software 106. Any one of these and/or other mechanisms may be used to trigger the activation of monitoring/alert functionality of the PER system.

The software in memory 92 of the microcontroller 84 comprises a source program, executable program (object code), script, or any other entity comprising a set of instructions/executable code to be run (performed). When a source program, then the program may be translated via a compiler, assembler, interpreter, or the like, so as to operate properly in connection with the operating system. Furthermore, the software/firmware can be written as (a) an object oriented programming language, which has classes of data and methods, or (b) a procedure programming language, which has routines, subroutines, and/or functions, for example but not limited to, C, C++, Python, Java, among others. The software may be embodied in a computer program product, which may be a non-transitory computer readable medium or other medium.

When certain embodiments of the PERS apparatus 82 are implemented at least in part with software, it should be noted that the software can be stored on a variety of non-transitory computer-readable medium for use by, or in connection with, a variety of computer-related systems or methods. In the context of this document, a computer-readable medium may comprise an electronic, magnetic, optical, or other physical device or apparatus that may contain or store a computer program (e.g., executable code or instructions) for use by or in connection with a computer-related system or method. The software may be embedded in a variety of computer-readable mediums for use by, or in connection with, an instruction execution system, apparatus, or device, such as a computer-based system, processor-containing system, or other system that can fetch the instructions from the instruction execution system, apparatus, or device and execute the instructions.

When certain embodiments of the PERS apparatus 82 are implemented at least in part with hardware, such functionality may be implemented with any or a combination of the following technologies, which are all well-known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), relays, contactors, etc.

It should be appreciated by one having ordinary skill in the art, in the context of the present disclosure, that certain known components may be omitted for the sake of brevity and simplicity in illustration. For instance, in some embodiments, the microcontroller 84 may include analog to digital (ADC) components used to convert analog sensor data to digital data for processing by the microcontroller 84. Further, sensor signals may be conditioned by digital and/or analog filtering and/or signal processing devices and/or software, as would be understood by one having ordinary skill in the art in the context of the present disclosure.

Figure 8:
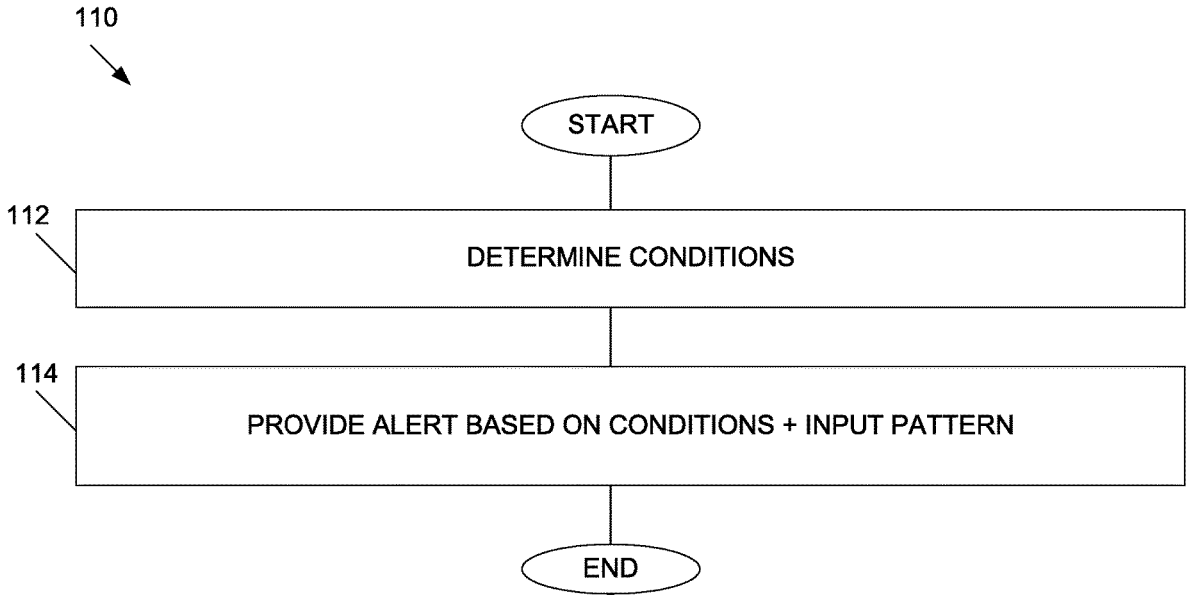
FIG. 8 is a flow diagram that illustrates an example PERS method for providing an alert in the absence of wearable device monitoring, in accordance with an embodiment of the invention.

In view of the description above, it should be appreciated that one embodiment of a computer-implemented, PERS method, depicted in FIG. 8 and referred to as a PERS method 110 (e.g., as executed at least by the PERS module 24, 24A and encompassed between start and end designations), comprises determining plural conditions including that a user is located within a monitored area and that a wearable device of the user is not being worn by the user (112); and providing an alert based on the plural conditions and based on receiving a pattern of input from one or plural sensors (114). As to the handover between the monitoring by the PERS wearable device 14 and the monitoring by the personal emergency response system, in one embodiment, the one or plural sensors 18 may only be evaluated for whether the user 42 is in the room and whether the user 42 is wearing the PERS wearable device 14. If both conditions are true, then the PERS module 24 is further activated to evaluate the input pattern from the one or plural sensors 18. As to the determination of condition as to whether the PERS wearable device 14 is being worn, in some embodiments, the charging apparatus 12 may comprise a switch that has a different state depending on whether the PERS wearable device 14 is in or on the charging apparatus 12 or not, the state and/or changed state indicated to the PERS module 24 (and hence providing an indication to the processor 88/PERS module 24 of whether the user is wearing the PERS wearable device 14). In some embodiments, the charging state of the PERS wearable device 14 may be expressed via data (status bit) available on the bus 94 (and input to a processor pin). In some embodiments, whether the PERS wearable device 14 is worn by the user 42 may be signaled by the PERS wearable device 14 to the PERS module 24. For instance, the state of being worn or not worn (and/or the state of charge) may be detected by sensors in the PERS wearable device 14 and signaled (e.g., wirelessly), and the PERS module 24 may be informed of the status based on receipt of the wirelessly communicated signal via the communication and location module 86. In some embodiments, if the status of the PERS wearable device 14 indicates that the battery of the PERS wearable device 14 is close to running out of charge and yet not connected to the charging apparatus 12 (or not properly connected), the PERS apparatus 82 and/or the PERS wearable device 14 may provide an alert to the user 42 to motivate the user 42 to secure the PERS wearable device 14 to the charging apparatus 12.

Any process descriptions or blocks in flow diagrams should be understood as representing modules, segments, or portions of code which include one or more executable instructions for implementing specific logical functions or steps in the process, and alternate implementations are included within the scope of the embodiments in which functions may be executed out of order from that shown or discussed, including substantially concurrently or in reverse order, depending on the functionality involved, as would be understood by those reasonably skilled in the art of the present disclosure. Further, it should be appreciated that decision blocks may be configured in logic that is the inverse of what is depicted to achieve similar overall functionality. For instance, non-motion as opposed to motion, or motion as opposed to non-motion, may be monitored, with the corresponding Boolean logic likewise interchanged, in some embodiments.

In one embodiment, a method is disclosed, comprising: determining plural conditions including that a user is located within a monitored area and that a wearable device of the user is not being worn by the user; and providing an alert based on the plural conditions and based on receiving a pattern of input from one or plural sensors.

In one embodiment, the preceding method, wherein the determining that the user is located within the monitored area is based on receiving input from the one or plural sensors.

In one embodiment, any one of the preceding methods, wherein the determining that the wearable device of the user is not being worn by the user is based on one or a combination of receiving an internal indication of whether there is a charging operation occurring between the wearable device and a charging apparatus or receiving an externally communicated indication that the wearable device is or is not being worn, is out of charge, or is corrupted.

In one embodiment, any one of the preceding methods, wherein the receiving of the pattern of input corresponds to one or a combination of motion detection and non-motion detection events detected from the one or plural sensors, at least one of the one or plural sensors associated with only one zone among a plurality of non-overlapping zones collectively monitored by the one or plural sensors.

In one embodiment, any one of the preceding methods, wherein a motion detection event corresponds to a detection of user activity and a non-motion detection event corresponds to termination of the detection of the user activity, and the plural sensors comprise a first sensor arranged to monitor user activity on a bed surface in a room and a second sensor arranged to monitor user activity on a floor surface of the room, further comprising providing the alert based on the pattern comprising a latest non-motion detection event of the second sensor occurring after a latest non-motion detection event of the first sensor plus a predetermined duration after the latest non-motion detection event of the first sensor.

In one embodiment, any one of the preceding methods, further comprising providing the alert based on the pattern comprising no user activity detected a predetermined duration after a latest non-motion detection event of the second sensor.

In one embodiment, any one of the preceding methods, further comprising determining whether to provide the alert based on an evaluation of primitive sleep events based on input from the first and second sensors relative to multiple determined states of user activity, wherein sleep epochs of the primitive sleep events are combined or discarded based on one or a combination of a predetermined duration of each of the sleep epochs or a predetermined gap between time-adjacent sleep epochs.

In one embodiment, the preceding method, wherein the multiple determined states of user activity comprise an out-of-bed state, an awake state, and an asleep state.

In one embodiment, the preceding method, further comprising abstaining from providing the alert when there is no sensor activity for a predetermined duration based on the evaluation and a determination that the user is in an asleep state.

In one embodiment, any one of the preceding methods, further comprising determining whether to send an alert based on the user moving to a location outside of a range of the first and second sensors.

In one embodiment, any one of the preceding methods, wherein providing the alert comprises indicating to one or more devices that the user is experiencing an emergency situation, wherein the emergency situation comprises a fall by the user or condition of incapacity of the user.

In one embodiment, any one of the preceding methods, further comprising determining a sleep behavior of the user based on input from the one or plural sensors.

In one embodiment, a non-transitory, computer-readable storage medium is disclosed, comprising instructions that, when executed by one or more processors, cause the one or more processors to perform any one of the preceding methods.

In one embodiment, an apparatus is disclosed, comprising the one or more processors and the non-transitory computer-readable storage medium of the preceding non-transitory, computer-readable storage medium.

In one embodiment, a system is disclosed, comprising the apparatus and the one or plural sensors of any one of the preceding methods, non-transitory, computer-readable storage medium, or apparatus, and further including a charging apparatus and the wearable device.

Note that various combinations of the disclosed embodiments may be used, and hence reference to an embodiment or one embodiment is not meant to exclude features from that embodiment from use with features from other embodiments. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical medium or solid-state medium supplied together with or as part of other hardware, but may also be distributed in other forms. Any reference signs in the claims should be not construed as limiting the scope.

The invention claimed is:

1. A method, comprising:

determining plural conditions including that a user is located within a monitored area and that a wearable device of the user is not being worn by the user; and providing an alert based on the plural conditions and based on receiving a pattern of input from one or plural sensors, wherein the determining that the wearable device of the user is not being worn by the user is based on receiving an internal indication of whether there is a charging operation occurring between the wearable device and a charging apparatus.

2. The method of claim 1, wherein the determining that the user is located within the monitored area is based on receiving input from the one or plural sensors.

3. The method of claim 1, wherein the receiving of the pattern of input corresponds to one or a combination of motion detection and non-motion detection events detected from the one or plural sensors, at least one of the one or plural sensors associated with only one zone among a plurality of non-overlapping zones collectively monitored by the one or plural sensors.

4. The method of claim 1, wherein a motion detection event corresponds to a detection of user activity and a non-motion detection event corresponds to termination of the detection of the user activity, and the plural sensors comprise a first sensor arranged to monitor user activity on a bed surface in a room and a second sensor arranged to monitor user activity on a floor surface of the room, further comprising providing the alert based on the pattern comprising a latest non-motion detection event of the second sensor occurring after a latest non-motion detection event of the first sensor plus a predetermined duration after the latest non-motion detection event of the first sensor.

5. The method of claim 4, further comprising providing the alert based on the pattern comprising no user activity detected a predetermined duration after a latest non-motion detection event of the second sensor.

6. The method of claim 1, wherein providing the alert comprises indicating to one or more devices that the user is experiencing an emergency situation, wherein the emergency situation comprises a fall by the user or condition of incapacity of the user.

7. The method of claim 1, further comprising determining a sleep behavior of the user based on input from the one or plural sensors.

8. The method of claim 1, wherein the determining that the wearable device of the user is not being worn by the user is based on receiving an externally communicated indication that the wearable device is or is not being worn, is out of charge, or is corrupted.

9. A method, comprising:

determining plural conditions including that a user is located within a monitored area and that a wearable device of the user is not being worn by the user; and providing an alert based on the plural conditions and based on receiving a pattern of input from one or plural sensors, wherein a motion detection event corresponds to a detection of user activity and a non-motion detection event corresponds to termination of the detection of the user activity, and the plural sensors comprise a first sensor arranged to monitor user activity on a bed surface in a room and a second sensor arranged to monitor user activity on a floor surface of the room, further comprising providing the alert based on the pattern comprising a latest non-motion detection event of the second sensor occurring after a latest non-motion detection event of the first sensor plus a predetermined duration after the latest non-motion detection event of the first sensor; and wherein determining whether to provide the alert is further based on an evaluation of primitive sleep events based on input from the first and the second sensors relative to multiple determined states of user activity, wherein sleep epochs of the primitive sleep events are combined or discarded based on one or a combination of a predetermined duration of each of the sleep epochs or a predetermined gap between time-adjacent sleep epochs.

10. The method of claim 9, wherein the multiple determined states of user activity comprise an out-of-bed state, an awake state, and an asleep state.

11. The method of claim 10, further comprising abstaining from providing the alert when there is no sensor activity for a predetermined duration based on the evaluation and a determination that the user is in an asleep state.

12. A method, comprising:

determining plural conditions including that a user is located within a monitored area and that a wearable device of the user is not being worn by the user; and providing an alert based on the plural conditions and based on receiving a pattern of input from one of plural sensors, wherein a motion detection event corresponds to a detection of user activity and a non-motion detection event corresponds to termination of the detection of the user activity, and the plural sensors comprise a first sensor arranged to monitor user activity on a bed surface in a room and a second sensor arranged to monitor user activity on a floor surface of the room, further comprising providing the alert based on the pattern comprising a latest non-motion detection event of the second sensor occurring after a latest non-motion detection event of the first sensor plus a predetermined duration after the latest non-motion detection event of the first sensor; and wherein determining whether to send the alert is based on the user moving to a location outside of a range of the first and second sensors.

13. An apparatus, comprising:

a memory comprising instructions; and one or more processors configured to execute the instructions to:

determine plural conditions including that a user is located within a monitored area and that a wearable device of the user is not being worn by the user; and provide an alert based on the plural conditions and based on receiving a pattern of input from one or plural sensors, wherein the apparatus comprises charging functionality for the wearable device.

14. A non-transitory computer readable medium encoded with instructions that, when executed by one or more processors, causes the one or more processors to:

determine plural conditions including that a user is located within a monitored area and that a wearable device of the user is not being worn by the user; and provide an alert based on the plural conditions and based on receiving a pattern of input from one or plural sensors, wherein the determining that the wearable device of the user is not being worn by the user is based on receiving an internal indication of whether there is a charging operation occurring between the wearable device and a charging apparatus.

* * * * *